US009161621B1

(12) United States Patent
Huffin

(10) Patent No.: US 9,161,621 B1
(45) Date of Patent: Oct. 20, 2015

(54) TOILETRIES DISPENSER

(71) Applicant: Sherry Huffin, Charlotte, NC (US)

(72) Inventor: Sherry Huffin, Charlotte, NC (US)

( * ) Notice: Subject to any disclaimer, the term of this patent is extended or adjusted under 35 U.S.C. 154(b) by 0 days.

(21) Appl. No.: 14/485,787

(22) Filed: Sep. 14, 2014

(51) Int. Cl.

| | |
|---|---|
| ***B65H 19/00*** | (2006.01) |
| ***B65H 49/00*** | (2006.01) |
| ***B65H 61/00*** | (2006.01) |
| ***A47B 81/00*** | (2006.01) |
| ***A47K 17/02*** | (2006.01) |
| ***A47K 10/18*** | (2006.01) |
| ***A47B 88/04*** | (2006.01) |

(52) U.S. Cl.
CPC ..... *A47B 81/00* (2013.01); *A47B 88/04* (2013.01); *A47K 10/18* (2013.01); *A47K 10/185* (2013.01); *A47K 17/02* (2013.01)

(58) Field of Classification Search
CPC ..... A47K 2010/3253; A47K 2010/3266; A47K 10/38; A47K 10/40; A47B 67/04
USPC ..... 312/34.22, 34.1, 34.3, 34.8, 34.19, 312/34.2, 34.23, 34.24, 280, 290, 242, 245; 242/560.2
See application file for complete search history.

(56) References Cited

U.S. PATENT DOCUMENTS

| | | | | | |
|---|---|---|---|---|---|
| 342,883 | A | * | 6/1886 | Stolte | 312/224 |
| 416,919 | A | * | 12/1889 | Hungas | 312/227 |
| 509,242 | A | * | 11/1893 | Parks | 211/1.3 |
| 568,706 | A | * | 9/1896 | Shipman | 312/290 |
| 1,336,140 | A | * | 4/1920 | Howard | 242/598.4 |
| 1,654,616 | A | * | 1/1928 | Spann | 312/204 |
| 2,182,831 | A | * | 12/1939 | Wagner | 242/564.4 |
| 2,440,974 | A | * | 5/1948 | Resch | 312/31 |
| 2,592,346 | A | * | 4/1952 | Scogin | 242/558 |
| 2,661,481 | A | * | 12/1953 | Goodfield | 4/420 |
| 2,738,898 | A | * | 3/1956 | Lee | 221/35 |
| 3,100,066 | A | * | 8/1963 | Campbell | 222/180 |
| 3,220,790 | A | * | 11/1965 | White | 312/240 |
| 3,245,626 | A | * | 4/1966 | Casteel | 242/560.3 |
| 3,295,900 | A | * | 1/1967 | Kendall | 312/34.22 |
| 3,443,850 | A | * | 5/1969 | Scime et al. | 312/312 |
| 3,542,446 | A | * | 11/1970 | Joyce | 312/244 |
| 3,754,804 | A | * | 8/1973 | Cushman | 312/71 |
| 3,791,601 | A | * | 2/1974 | Broden | 242/419 |
| 4,008,933 | A | | 2/1977 | Wanek | |
| 4,124,259 | A | * | 11/1978 | Harris | 312/34.22 |
| D257,082 | S | * | 9/1980 | Williams | D6/519 |
| 4,338,987 | A | * | 7/1982 | Miles | 144/285 |
| 4,660,902 | A | * | 4/1987 | Resendez, Jr. | 312/114 |
| 5,197,611 | A | * | 3/1993 | Walton | 211/59.2 |
| 5,577,819 | A | | 11/1996 | Olsen | |
| 5,624,025 | A | * | 4/1997 | Hixon | 206/233 |
| 5,687,854 | A | * | 11/1997 | Anderson | 211/59.2 |

(Continued)

FOREIGN PATENT DOCUMENTS

| | | | |
|---|---|---|---|
| DE | 3229475 | * | 2/1984 |
| FR | 2553652 | * | 4/1985 |
| JP | 2008-200497 | * | 9/2008 |

*Primary Examiner* — Daniel J Troy
*Assistant Examiner* — Kimberley S Wright

(57) ABSTRACT

The inventive device disclosed in the present application is a convenient multi-purpose restroom storage and dispensation device. The device stores many common household toiletries and dispenses toilet paper in a more aesthetic manner, allowing the user to effortlessly have any necessary utilities at their disposal in one location. It is emphasized that this abstract is provided to comply with the rules requiring an abstract that will allow a searcher or other reader to quickly ascertain the subject matter of the technical disclosure.

1 Claim, 3 Drawing Sheets

(56) References Cited

U.S. PATENT DOCUMENTS

| | | | | |
|---|---|---|---|---|
| 6,182,612 | B1 * | 2/2001 | Ross, Sr. | 119/482 |
| 6,302,350 | B1 * | 10/2001 | Burrell et al. | 242/560 |
| 6,405,971 | B1 * | 6/2002 | Trecartin | 242/592 |
| 6,527,219 | B1 * | 3/2003 | Trecartin | 242/592 |
| 6,769,542 | B2 | 8/2004 | Polito | |
| D508,793 | S * | 8/2005 | Walker | D6/408 |
| 7,198,339 | B2 | 4/2007 | Baron | |
| 7,222,747 | B1 * | 5/2007 | Savran | 221/34 |
| D545,099 | S * | 6/2007 | Fernandez, Jr. | D6/524 |
| D551,000 | S * | 9/2007 | Romano | D6/520 |
| 7,355,131 | B2 | 4/2008 | Pathmanathan et al. | |
| 7,380,292 | B1 * | 6/2008 | Harris | 4/213 |
| 7,467,801 | B1 * | 12/2008 | Garduno | 280/47.26 |
| D624,769 | S * | 10/2010 | Pierre-Louis | D6/520 |
| 8,075,071 | B1 * | 12/2011 | Whittall | 312/249.12 |
| 2002/0027402 | A1 | 3/2002 | Hanser | |
| 2006/0289558 | A1 * | 12/2006 | Parker | 221/97 |
| 2007/0013280 | A1 * | 1/2007 | Retchloff | 312/319.8 |
| 2008/0120256 | A1 * | 5/2008 | Lisook et al. | 705/500 |
| 2008/0136130 | A1 * | 6/2008 | Washington | 280/47.17 |
| 2008/0245699 | A1 * | 10/2008 | Salazar | 206/575 |
| 2009/0211003 | A1 * | 8/2009 | Harris | 4/227.1 |
| 2009/0212674 | A1 * | 8/2009 | Harris | 312/237 |
| 2009/0223993 | A1 * | 9/2009 | Lorenzati | 221/35 |
| 2009/0315436 | A1 * | 12/2009 | Robinson et al. | 312/249.11 |
| 2010/0163569 | A1 * | 7/2010 | Parker | 221/1 |
| 2011/0215008 | A1 * | 9/2011 | Carroll | 206/213.1 |
| 2012/0223627 | A1 | 9/2012 | Wylie et al. | |
| 2012/0278985 | A1 | 11/2012 | Cornille | |
| 2012/0305588 | A1 | 12/2012 | Gerschwiler Steck et al. | |
| 2013/0055499 | A1 | 3/2013 | Serda | |

* cited by examiner

TOILETRIES DISPENSER

CLAIM OF PRIORITY FROM RELATED APPLICATIONS

The present application claims priority from U.S. Provisional Patent Application No. 61/859,743 filed on Jul. 29, 2013 to Sherry Huffin, from Charlotte, N.C. (U.S.A.) directed to a "Sherry's Toiletries Dispenser", that is hereby incorporated by reference.

BACKGROUND OF THE INVENTION

1. Field of the Invention

The present invention relates to storage machinery. More specifically, for the purpose of storing and dispensing toiletries.

2. Brief Description of the Prior Art

Multipurpose toilet dispensation devices are well known in the art. For example, U.S. Pat. No. 7,198,339 to Baron discloses and claims a bathroom storage system convenient for storage of hair care items, such as hair blowers and hair curling irons wherein receptacles are positioned in a bathroom cabinet to extend around the sink and into the normally unused upper space of the cabinet; the items being inserted into the receptacles and retrieved from the receptacles through a pivoting front panel and having inserted tubes projecting from inner ends to receive hot tips of hair curling irons and the like; and the receptacles being cantilevered from a front face of the cabinet, with a pivoted lip of each receptacle secured to the front face and hinge connections allowing the receptacles to extend angularly downwardly from the front panel.

U.S. Pat. No. 6,769,542 to Polito discloses and claims, a bathroom accessory in the form of three canisters with lids connected together, to conveniently store often needed tools near the bathroom commode. These tools include a suction-type plunger device, extra rolls of toilet tissue, and a brush to clean a toilet, all which can be accessed by lifting the lids, reaching in and pulling the tool upward and out of its canister. For store shelf compactness, storing, or moving this accessory, the invention also disassembles, and all of it's contents (minus the toilet paper) can be put inside the plunger canister, making an efficient size for shipping this product to the customer.

U.S. Patent Application No. 20,130,055,499 A1 to Serda discloses and claims, the invention relates to a foldable and stackable bathroom cabin having multiple purposes such as a dressing room and a storage room, as toilet and shower; which can be connected directly to the waste discharge network. It is equipped with four telescopic columns, foldable in sections controlled by means of casings, with securing mechanisms ending in the corresponding end deployment stops on the upper part of said columns. It is equipped with fabric tarpaulins for the walls and zipper closure on its front wall; and on the upper part of said columns there are arranged four cone-shaped stops for its support and balance during stacking of said cabins in the folded state. When folded, they allow storing up to 200 cabins in a space of 5.9×6.15×5.9 meters. The cabin is equipped with fittings for use in the modes of chemical recirculating toilets; squat toilets; dry toilets with mechanical waste discharge; and vacuum toilets.

U.S. Patent Application No. 20,020,027,402 A1 to Hanser discloses and claims, a bathroom accessory storage system for storage of bathroom consumables such as bathroom tissue, bar soap, or the like, and to covertly store bathroom accessories such as a toilet plunger, toilet cleaning brush, or the like, in a single furnishing.

U.S. Patent Application No. 20,120,278,985 A1 to Cornille discloses and claims, the invention relates to a standalone bathroom including a prefabricated enclosure intended for being placed on in the floor of a room of a dwelling, said enclosure being made up of the combination of at least two modules: at least one bathroom module containing bathroom fittings (6, 7, 8) and a technical module (10) comprising a means for supplying the bathroom fittings (6, 7, 8) with clean water, characterised in that the technical module (10) also comprises a means for supplying cold water and hot water and a means for supplying power to the bathroom module(s) and, in particular, the bathroom fittings (6, 7, 8), the technical module (10) guaranteeing the standalone nature of said bathroom module(s), a means for collecting the wastewater produced by the bathroom fittings (6, 7, 8), and a tank (11) for storing said wastewater, mounted on a movable truck (17).

U.S. Patent Application No. 20,120,305,588 A1 to Steck et al. discloses and claims, a personal hygiene storage unit that functions both as a hanging storage/dispensing unit and as a personal hygiene travel pack includes: (a) a hollow body with a bottom, upwardly projecting walls and an open top; (b) a back hatch top hingeably connected to the back wall of the bottom and having closing mechanism to fix the back hatch top in a closed position; (c) a front hatch top hingeably connected to the front wall of the bottom; and, (d) a pair of opposing elongated hanging hooks connected to at least one of the main housing, the back hatch top and the front hatch top, for attachment to a toilet paper roll rod and hinges for folding the hooks to create a compact travel pack.

U.S. Pat. No. 7,355,131 to Pathmanathan et al. discloses and claims, a novel bathroom vanity provides storage space for a bathroom scale and makes efficient use of the volume occupied in the bathroom by the vanity. In several embodiments, the bathroom scale is stored in a drawer in a kick panel, the drawer being moved between a closed position, wherein the scale is stored, and an open position wherein the scale can be used. Preferably, the scale is capable of providing a digital output of its readings to a digital display on the vanity.

U.S. Pat. No. 4,008,933 to Wanek discloses and claims, a utilitarian and decorative piece of bathroom furniture adapted to provide a plurality of separate storage compartments for materials and devices used within the bathroom. The accessory is characterized by a central housing enclosing a storage compartment for several rolls of toilet tissue flanked on opposite sides by a compartment for storing several bars of soap on one side and for storing a toilet bowl brush on the other. The cover for the toilet tissue storage compartment is in the form of a further storage compartment for bath powder, or the like. According to one form of the invention, a drain cleaning plunger is concealed within the central storage housing.

U.S. Pat. No. 5,577,819 to Olsen discloses and claims, a bathroom storage cabinet for electrically operated appliances such as hair dryers and hair curlers. Receptacles for the appliance cords are provided within the cabinet by a power bar, which is placed within an interior compartment utilized for neatly storing coils of electric cord excess length. A lower shelf and barrier wall retains the length of cord actually needed, so that a front door may be closed neatly flush with the cabinet, equipped with a magnetic latch arrangement. A lowermost compartment provides room for non-electrical brushes, combs and other bathroom paraphernalia and materials. The cabinet is adapted for installation embedded into a bathroom wall, or hanging from the face of the bathroom wall, or resting upon the bathroom counter.

U.S. Patent No. 20,120,223,627 A1 to Wylie et al. discloses and claims, a toilet users rollable desk for A compact personal office desk for the commode user. The toilet users rollable desk generally includes A desk that provides the toilet user with a space between the knees and legs to read, write, use the computer and store personal items as well as a shelf to place coffee or nourishment. The toilet users rollable desk is also able to store toilet tissue, hold reading material and be conveniently moved in front of the commode user for all processes to be best utilized in the large, average or small toilet commode area.

Despite all the efforts listed above prior art patents describe structures that are either not truly protective or convenient or else involve complicated, expensive, and overly difficult assembly and/or disassembly parts and procedures. Other devices have been advertised on various media but never patented or described into a printed publication.

SUMMARY OF THE INVENTION

The inventive device disclosed in the present application is a convenient multi-purpose restroom storage and dispensation device. The device stores many common household toiletries and dispenses toilet paper in a more aesthetic manner, allowing the user to effortlessly have any necessary utilities at their disposal in one location.

It is then the principal object of the present invention to provide a more efficient way to store common household toiletries in one location. It is a secondary objective of the present invention to a provide an aesthetically appealing method for a user to dispense toilet paper.

It is an additional objective of the present invention to provide a portable device that can be effectively used by any person, with ease. It is a final objective of the present invention to provide a device that is cheap to build, but can eventually be sold at a premium.

These and other objectives achieved by the device of the present invention will be apparent by the drawings, by their detailed description, and by the specification here from appended.

DESCRIPTION OF THE PREFERRED EMBODIMENT

Figure 1:
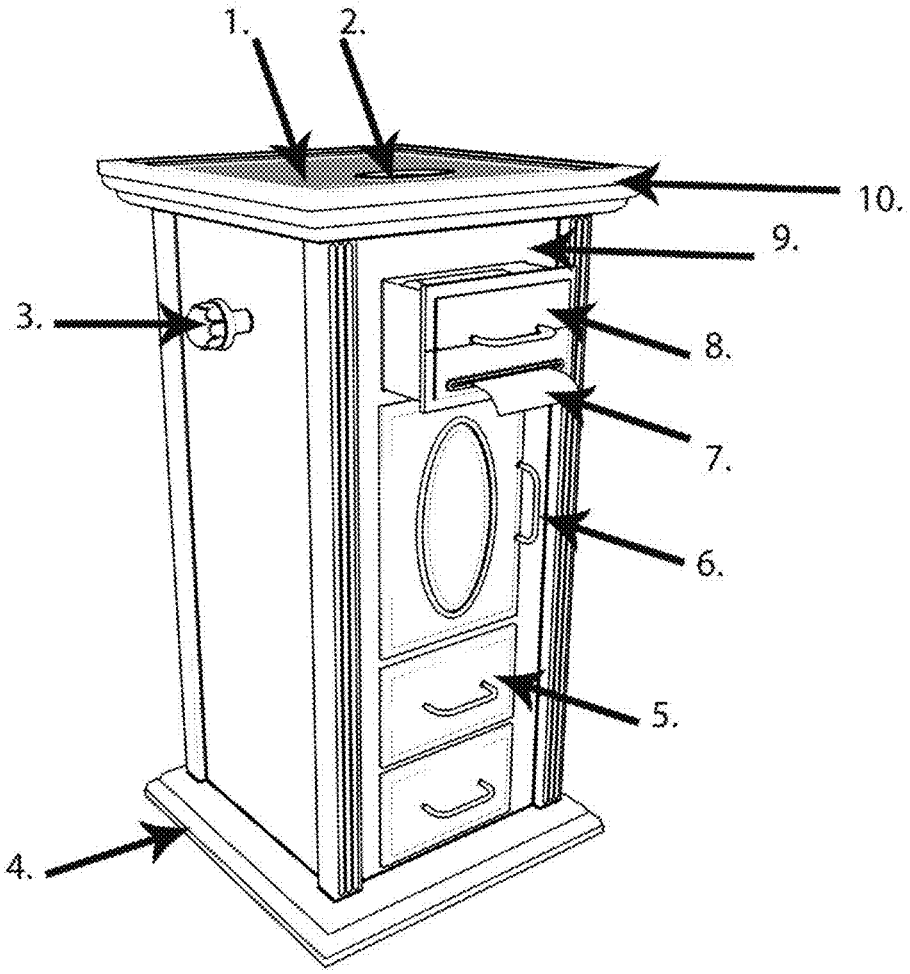
FIG. 1 is a perspective view of the device, displaying the multiple functions and attachments labeled in accordance with the teaching of the present invention.
Figure 2:
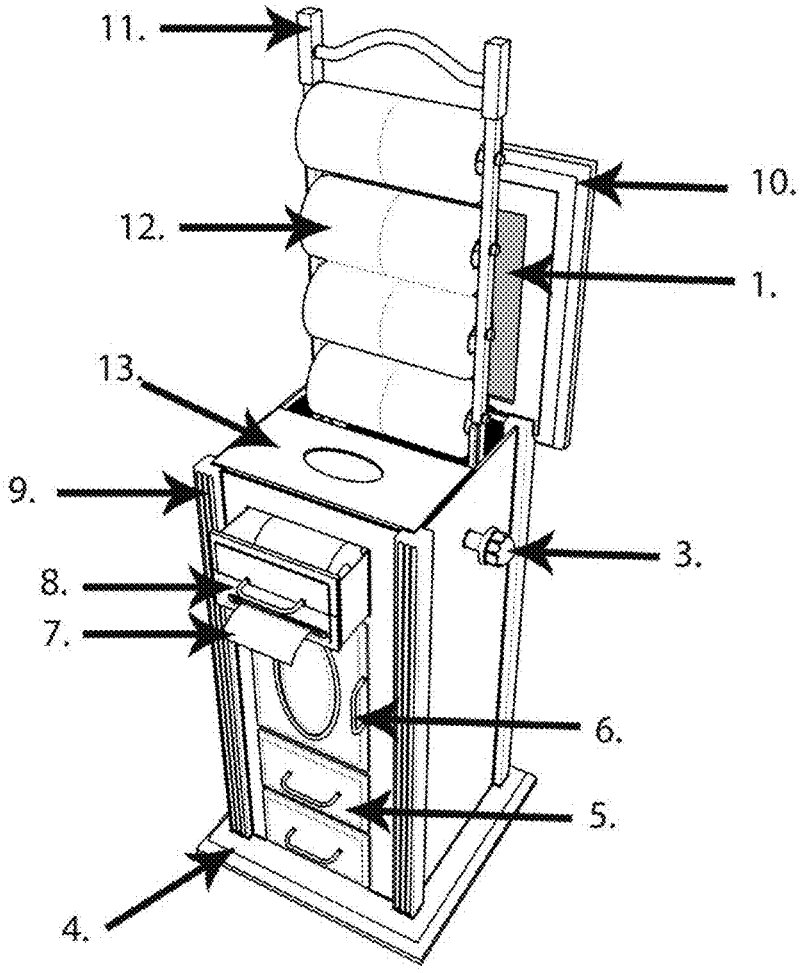
FIG. 2 is an angled, high-perspective view of FIG. 1 of "Sherry's Toiletries Dispenser", displaying the multiple functions of the device, displaying the toilet paper storage unit extended.
Figure 3:
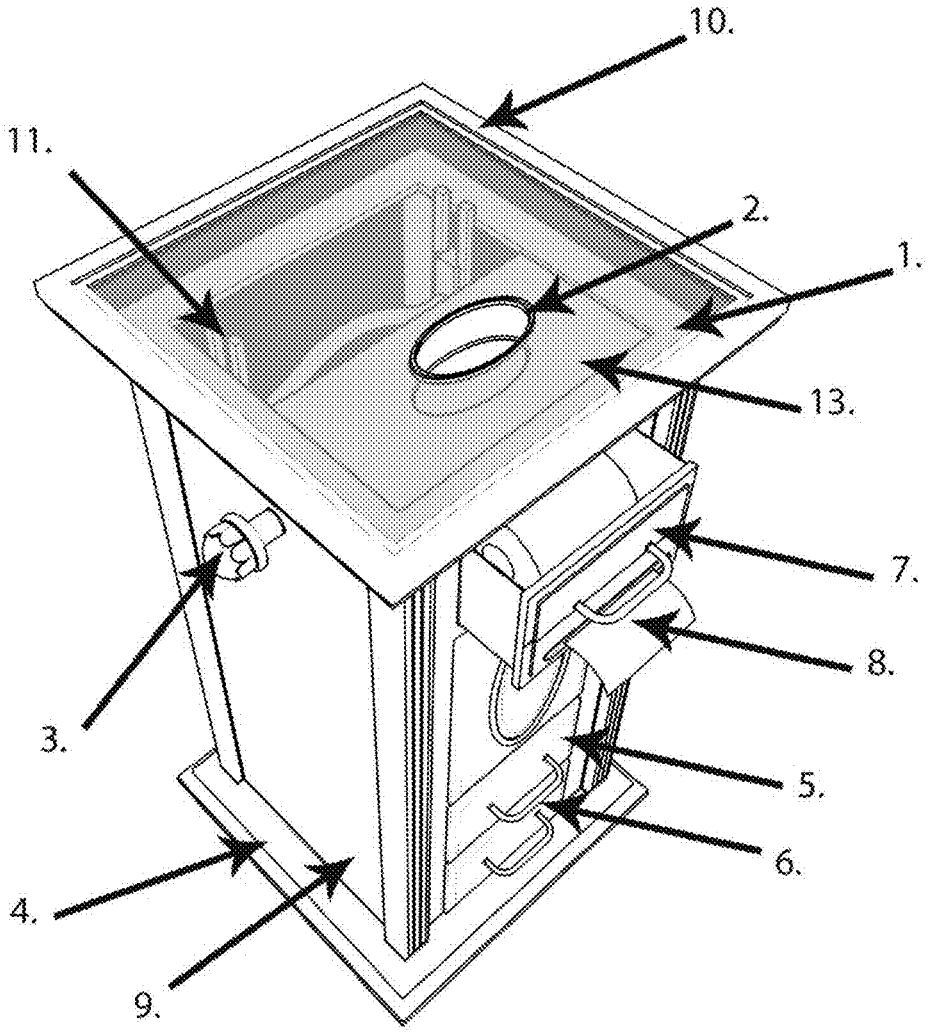
FIG. 3 contains an angled view of the device, prominently displaying the clear glass section and tissue dispensary.

The inventive device disclosed in the present application is a convenient multi-purpose restroom storage and dispensation device. The device stores many common household toiletries and dispenses toilet paper in a more aesthetic manner, allowing the user to effortlessly have any necessary utilities at their disposal in one location. As it can be inferred from the drawings essential components of "Sherry's Toiletries Dispenser" of the present application include: (1) clear glass inserted into the lid, (2) an opening for tissues to be pulled through, (3) a roller knob for decorative purposes, (4) a firm, sturdy base to support the inventive device, (5) multiple drawers for addition storage space, (6) sturdy handles, (7) toilet paper, (8) the drawer for the toilet paper to be stored in to prevent it from being damages or harmed by the elements, (9) the stable body of the inventive device, (10) the liftable lid covering of the dispenser, (11) the retractable toilet paper holder that rests within the inventive device, (12) the toilet paper reservoir, and finally, (13) the tissue box that also rests within the dispenser.

"Sherry's Toiletries Dispenser" is designed to allow the user to more effectively store common household toiletries. The concept is derived from a need to improve the toiletry storage in an aesthetically appealing manner. Since a more efficient storage device would be provided, the disclosed invention would provide for more efficient storage and dispensation of household toiletries.

In one of the separate preferred embodiments of the inventive device of the present application the toiletries dispenser consists of a restroom storage comprising: a sturdy base member, possibly rectangular or squared, supporting a generally cuboidal structure having six faces, a top, a bottom, a right, a left, a front, and a back side. Said top side may be transparent such as glass or plastic, and may be hingedly liftable. Just underneath said top side there is a base designed to support a box of tissue paper. Said top side may feature a central oval or round opening to give access to the tissue papers. Said bottom side is the sturdy base member.

In a separate preferred embodiment of the inventive device of the present application said base designed to support a box of tissue paper occupies approximately less than half the cross section of the cuboidal structure, being located close to the front side then it occupies approximately half of the front side The back side is occupied by a retractable toilet paper holder holding a plurality of rolls of toilet papers on two vertically retractable arms. A pin mechanism serves as lock to keep the toilet paper holder in its upright position.

Said hosting right, a left, a front, and a back side are joined by four square columns with corresponding recesses on at least two adjoining sides of their four sides. The recesses are designed to host the bordering sides. Said columns are firmly secured on said sturdy base member by a plurality of fastening means such as screws, nails, nuts and bolts, pins, or they can be glued together with glue or with an expoxic resin.

Held in said cuboidal structure having six faces is a first sliding drawer, composed by five sides a bottom side, a front side, a right side, a left side, and a back side. Where lateral sliding guides are affixed respectively on said right and left sides collectively referred as lateral sides. Said first sliding drawer has a handle securely attached on said front side by fastening means such as screw, nails, pins, nuts and bolts.

Underneath said first sliding drawer there is a second compartment including an internal cavity occupying a portion of space inside said generally cuboidal member, an opening in said front face of said cuboidal member and a swinging door hingedly attached to said front face of said cuboidal member by a plurality of hinges. Said hinges can be either laterally or disposed either on the top or the bottom side. A handle is used to open and close said swinging door.

A second and a third sliding drawers are subsequently placed in between said sliding drawer and said sturdy base member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toiletries dispenser comprising:

a cabinet having, an upper end, a first side, a second side, a front side and a rear side; said cabinet defining an interior including a square shaped cross-section and an opening located at said upper end;

a base is provided at a lower end of said cabinet for supporting the cabinet on a surface;

a support surface located in said interior at said upper end configured to support a first box of tissue paper in the interior, wherein said support occupies less than half of said square shaped cross-section;

a lid is configured to move between a closed position covering said opening and an open position exposing said opening, said lid including a first dispensing opening configured to provide access to said first box of tissue paper when said lid is in the closed position;

a plurality of drawers are arranged vertically under said support surface, at least one of said plurality drawers including a second dispensing opening configured to provide access to toilet paper; and a retractable toilet paper holder is mounted to said interior of the cabinet, said toilet paper holder comprises a plurality of horizontal rods attached between two vertically retractable arms, each horizontal rod is capable of supporting at least one toilet paper roll, wherein said retractable toilet paper holder is configured to move between a first and second position, the first position being said retractable toilet paper holder nested entirely within said interior with said lid in the closed position, and the second position includes the lid in said open position with said retractable toilet paper holder extending vertically through said opening and locked in place such that each horizontal rod is located outside of the interior.

* * * * *